United States Patent [19]

Nyman

[11] 4,238,000

[45] Dec. 9, 1980

[54] SCAFFOLD STRUCTURE

[76] Inventor: Curt L. Nyman, Skolvägen 22, Aplared, Sweden

[21] Appl. No.: 916,055

[22] Filed: Jun. 16, 1978

[51] Int. Cl.[3] ..... E04G 1/18; E04G 3/02

[52] U.S. Cl. ..... 182/136; 182/3; 182/82; 182/107; 182/146; 182/214

[58] Field of Search ..... 182/136, 133, 187, 145, 182/146, 229, 214, 107, 145, 146, 103

[56] References Cited

U.S. PATENT DOCUMENTS

| | | | |
|---|---|---|---|
| 1,307,468 | 6/1919 | Wells | 182/135 |
| 2,245,661 | 6/1941 | Fieroh | 182/8 |
| 2,311,352 | 2/1943 | Seiler | 182/136 |
| 3,323,616 | 6/1967 | Best | 182/146 |
| 3,760,902 | 9/1973 | Nyman | 182/103 |
| 3,910,378 | 10/1975 | Nyman | 182/103 |
| 4,008,785 | 2/1977 | Mugnaini | 182/133 |

*Primary Examiner*—Reinaldo P. Machado

*Attorney, Agent, or Firm*—Robert E. Burns; Emmanuel J. Lobato; Bruce L. Adams

[57] ABSTRACT

A scaffold structure comprising a tubular column positioned vertically in use by a base support for supporting a base end portion of the column. Top supporting structure supports a top end portion of the tubular column and is effective to maintain the column vertical in use. The base support and top support impart torsional rigidity to the tubular column. A positionable platform assembly having a platform for standing thereon is positionably mounted on the column for positioning the platform at a selected height above the base end of the column, and to permit adjustment of the height of the platform above the base end of the tubular column.

16 Claims, 12 Drawing Figures

SCAFFOLD STRUCTURE

BACKGROUND OF THE INVENTION

The present invention relates to a scaffold structure, and more particularly to a scaffold structure that is light in weight, strong and which has a high degree of torsional stability.

Various types of scaffold structure are known. The present applicant has himself previously patented different scaffold structures which are disclosed in U.S. Pat. Nos. 3,760,902 and 3,910,378, respectively. Both of these scaffold structures include a ladder which is supported in use in a vertical orientation by legs at the bottom of the ladder and by outwardly extending support members or arms at the top of the ladder. The support members at the top of the ladder rest against a wall or building or other structure, in use, to keep the ladder vertical. The known scaffold structures further include a platform assembly which is positionable along the ladder at different heights. A user of the scaffold structure stands on the platform assembly when the ladder is vertical and adjacent a structure on which work is to be preformed. As the work progresses the user of the scaffold structure can change the position of the platform assembly in order to change his position relative to the structure being worked on.

The use of a ladder-like structure in these scaffolds influences the degree of torsional stability which they exhibit. The ladder can be thought of as a planar structure in that its thickness dimension is small in comparison to its length dimension and width dimension. Accordingly, even if the ladder is very strong and can support large compressive loads relatively smaller loads will cause it to twist about its longitudinal axis. Therefore, in order to improve its torsional stability the ladder must be made quite strong and this requires massive components with attendant increases in expense and weight.

Additionally, the ladder itself is a relatively expensive component of the prior scaffold structures. The ladder is comprised of a pair of parallel rails having a plurality of rungs extending therebetween. The fabrication of the ladder includes steps of forming a plurality of holes in the rails for receiving the rungs, fitting the rungs into the rail holes, and securing the rungs and rails together. These steps add to the total cost of the prior scaffold structures which incorporate a ladder.

Finally, because the ladder used in the prior scaffold structures is comprised of a plurality of separate parts (rungs and side rails) which must be secured together, there is a continuing problem concerning the reliability of the ladder. Continuous and repeated use of the ladder puts stresses on the joints between the rungs and side rails of the ladder. These joints have a tendency to weaken and loosen so that the ladder itself may have a tendency to actually come apart. This is a substantial safety problem, and it is aggravated with age and use of the scaffold structures incorporating a ladder. It requires that the joints between the rungs and side rails of the ladder be extremely strong and consequently the ladder will be expensive.

SUMMARY OF THE INVENTION

It is therefore an object of the present invention to provide a vertical scaffold structure having a positionable platform for accommodating a person, and which is strong, light and reliable.

It is another object of the present invention to provide a vertical scaffold structure having a positionable platform for accommodating a user, and which has a high degree of torsional stability.

It is another object of the present invention to provide a vertical scaffold structure having a positionable platform for accommodating a user, and which has a unitary vertical support element.

In accordance with the objects of the present invention a scaffold structure is comprised of a tubular column positioned in use in a generally vertical orientation. When so positioned the column has a lower base end portion and an upper top end portion. Base supporting means supports the base end portion of the tubular column and imparts torsional rigidity to the tubular column to maintain the tubular column in a generally vertical orientation. Top supporting means supports the top end portion of the tubular column and imparts torsional rigidity to the column to maintain the tubular column in a generally vertical orientation. The scaffold structure also includes a positionable platform assembly including a platform dimensioned to permit a worker to stand thereon, and mounting means for positionably mounting the platform assembly on the tubular column at a selected position along the length thereof to permit selection and adjustment of the height of the platform above the base end portion of the tubular column.

In one embodiment the tubular column has a non-circular cross section. In a particular embodiment the non-circular cross section is D-shaped and has a side surface defined by a cylindrical portion and a flat portion. The flat portion of the side surface of the tubular column has holes therethrough dimensioned for allowing a worker to insert his hands and feet thereinto for climbing up the tubular column. These holes serve the purpose of rungs of a ladder.

The base supporting means comprises a rigid frame and means for engaging the lower base portion of the tubular column at positions along the length of the lower base portion and on opposite sides of the lower base portion. The means for engaging secures the lower base portion at the portions of the tubular column engaged to the rigid frame for imparting torsional rigidity to the tubular column.

The rigid frame includes hinge means for defining a hinge mounted on the tubular column at the lower base portion thereof at a distance from a lower end of the tubular column, and a pair of rigid legs having respective first ends spaced apart and respectively extending toward and meeting at said hinge means mounted on said tubular column. The pair of legs are oriented relative to the tubular column with the lower end of the column and the respective first ends of the legs defining a triangle generally perpendicular to the tubular column when the tubular column is in a generally vertical orientation and being supported by the base supporting means. A brace spans between the respective first ends of the legs and extends around the tubular column on a side thereof opposite the side on which the hinge means is mounted. The brace includes means for releasably engaging the bottom end of the tubular column on a side thereof opposite the hinge means when the tubular column is oriented generally vertical, and for releasing the bottom end of the tubular column as the tubular column is pivoted about the hinge means in a direction to move the bottom end of the tubular column away from the base.

The top supporting means is comprised of a rigid frame, and means for engaging the top end portion of the tubular column at positions along the length of the top end portion on opposite sides thereof and around a substantial peripheral portion of the tubular column, for securing the top end portion at the positions engaged to the rigid frame for imparting torsional rigidity to the tubular column. The rigid frame is comprised of a pair of rigid legs having respective first ends spaced apart and respectively extending toward and meeting at the tubular column. The pair of rigid legs meet and merge together to define the means for engaging the top end portion. The means for engaging the top end portion of the column comprises a bracket enclosing the tubular column, and a brace spanning between the pair of rigid legs and defining a second bracket enclosing and gripping the tubular column and having a portion complementary to a substantial portion of the cross section of the tubular column for preventing rotation of the second bracket and the rigid leg relative to the tubular columns.

The mounting means mounting the positionable platform assembly is comprised of the platform which includes releasable engaging means for releasably engaging the tubular column for maintaining the platform at a fixed position along the length of the tubular column, and positioning means for maintaining the platform adjacent the tubular column and for imparting torsional rigidity to the tubular column. The positioning means is comprised of a frame, means for slideably mounting the frame on the tubular column, and means for movably mounting the platform on the frame to move between a position with the releasable engaging means of the platform engaged with the tubular column, to thereby maintain the platform and the mounting means at a fixed position on the tubular column, and a second position with the releasable engaging means disengaged from the tubular column to thereby allow the platform and the mounting means to travel along the length of the tubular column.

BRIEF DESCRIPTION OF THE DRAWINGS

Other features and advantages of the scaffold structure according to the present invention will appear from the following description of the preferred embodiments of the invention in conjunction with the drawings, in which.

DESCRIPTION OF THE PREFERRED EMBODIMENT

Figure 1:
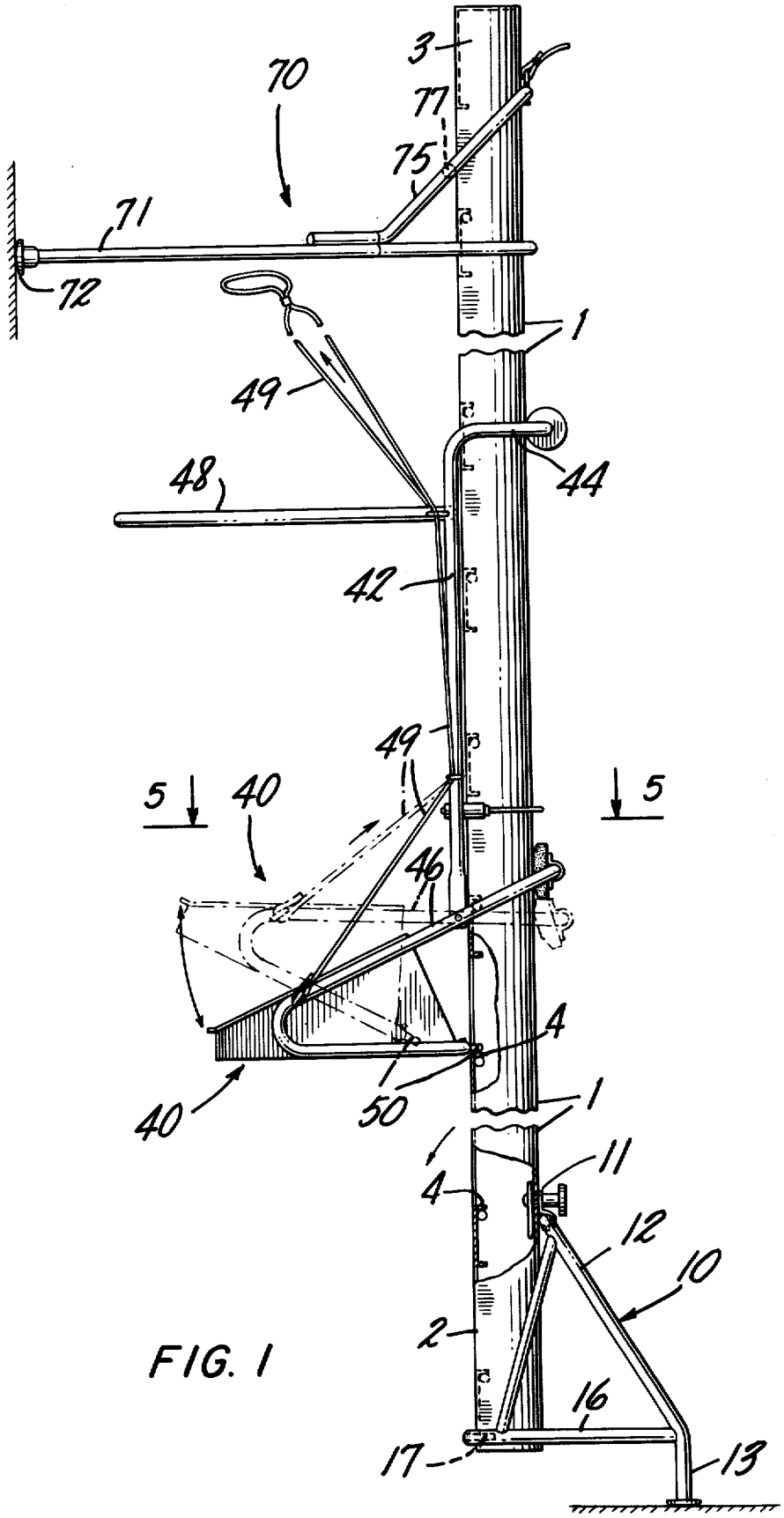
FIG. 1 is a side elevation view of the scaffold structure according to the present invention.
Figure 2:
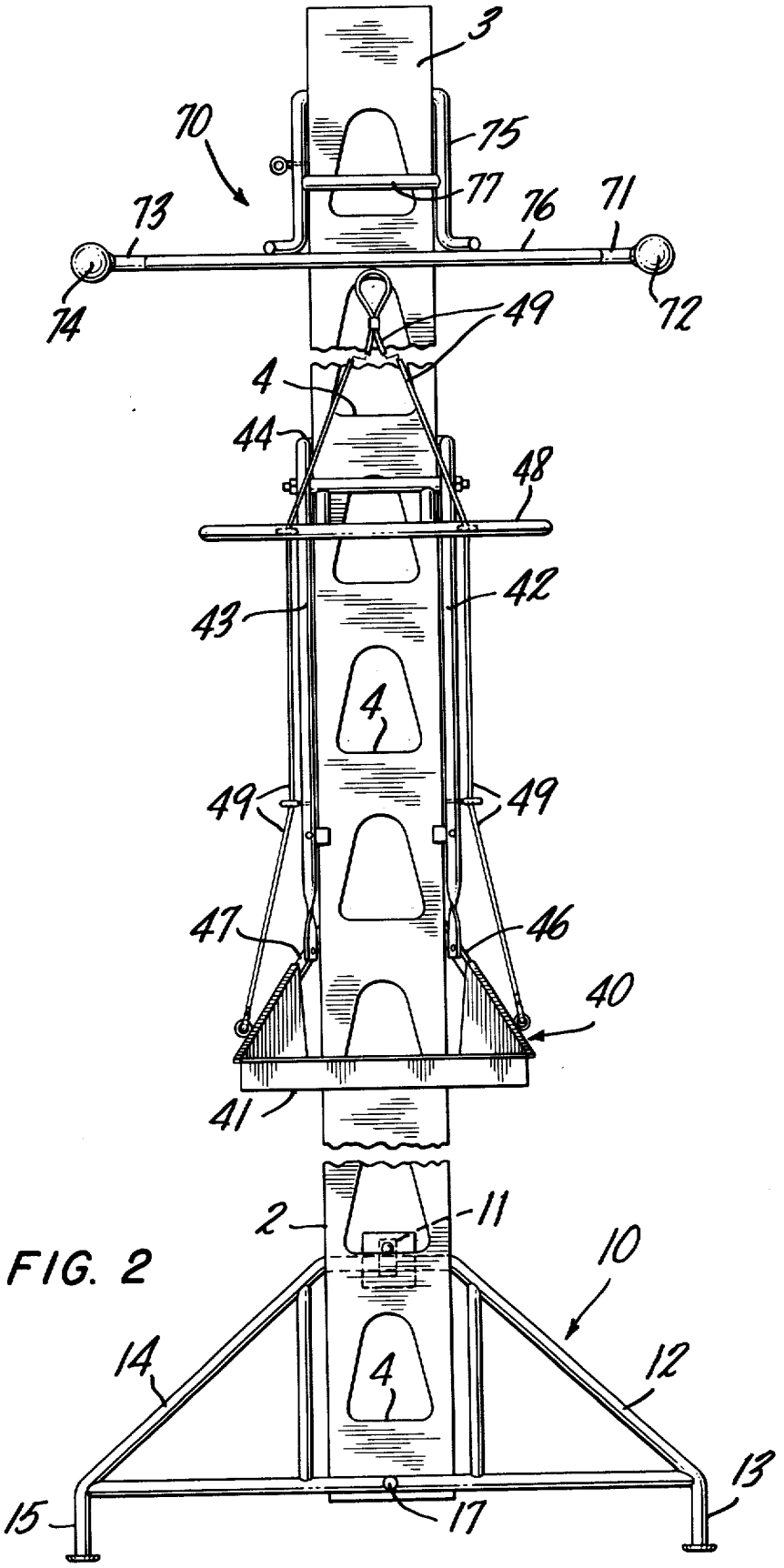
FIG. 2 is a front elevation view of the scaffold structure illustrated in FIG. 1.
Figure 3:
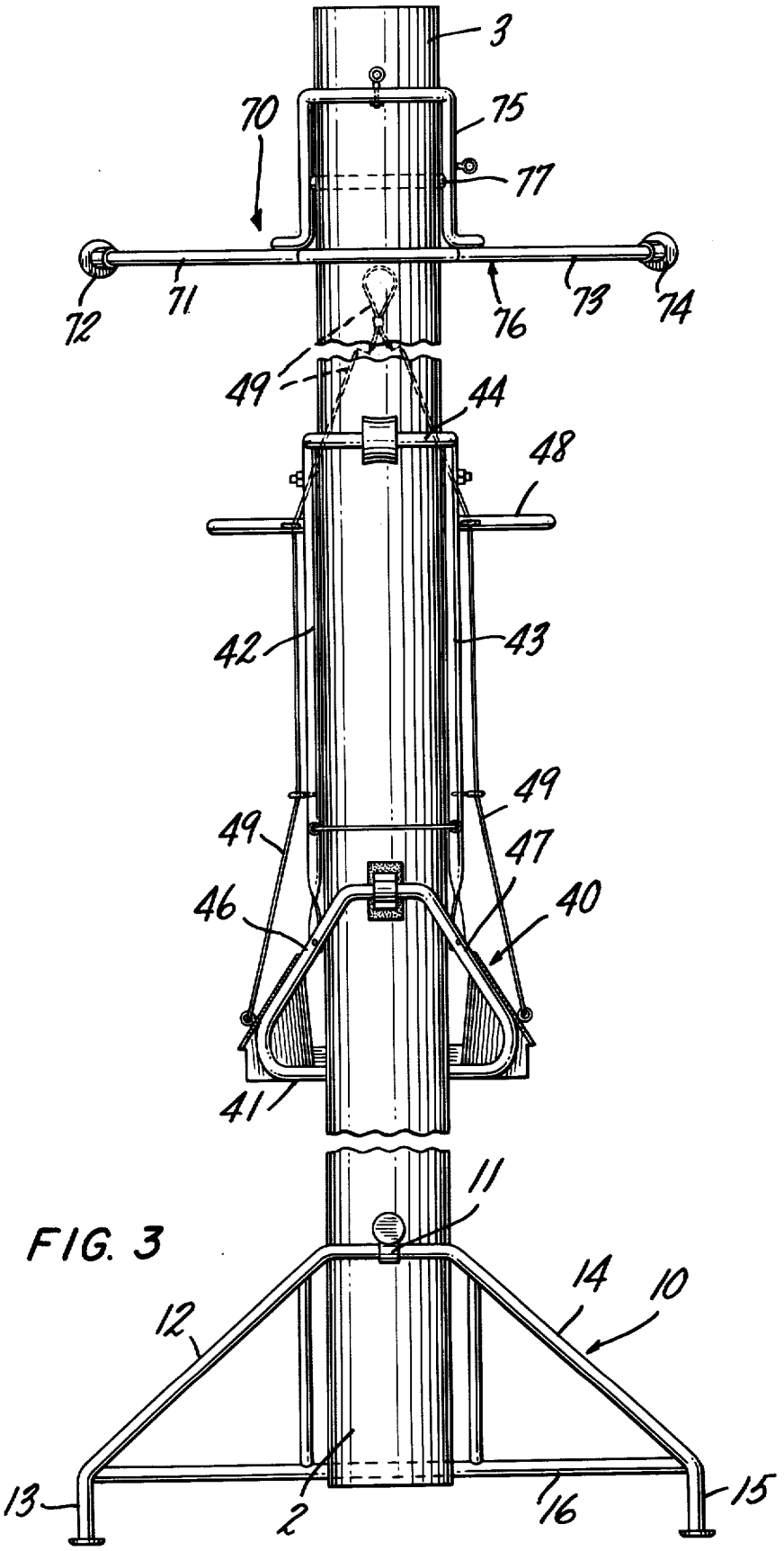
FIG. 3 is a back elevation view of the scaffold structure illustrated in FIG. 1.
Figure 4:
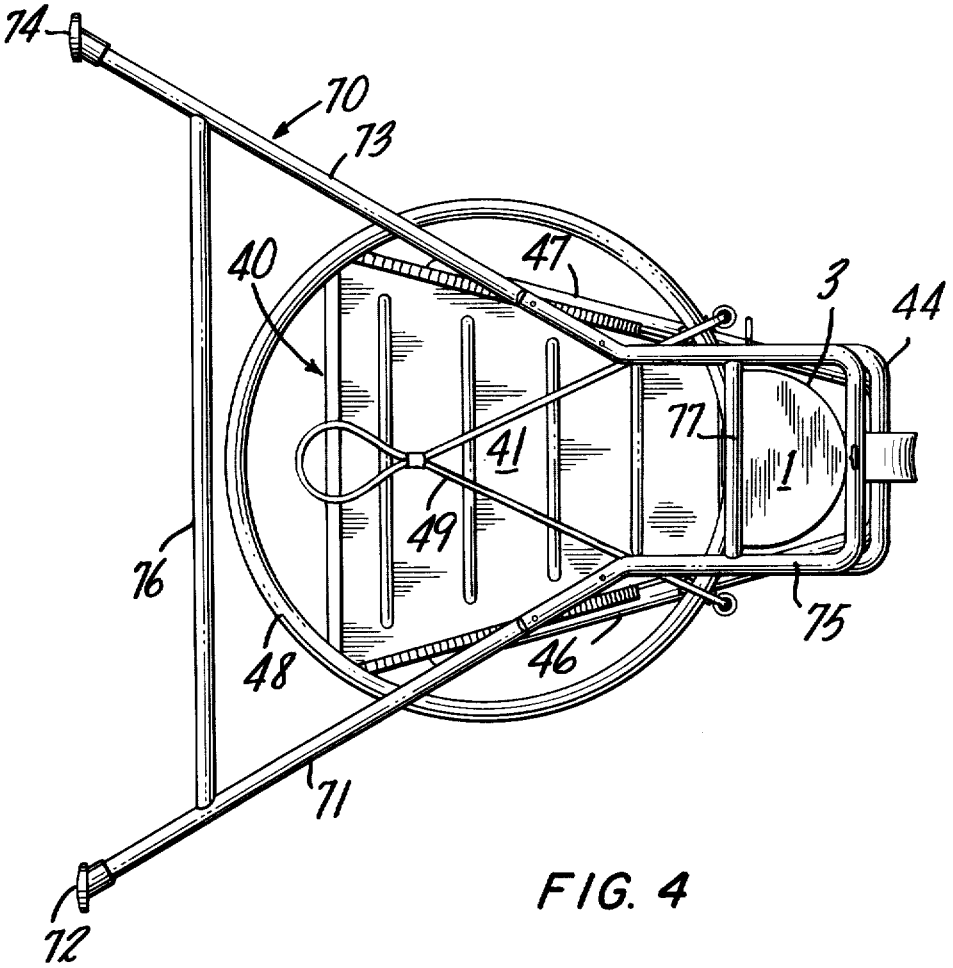
FIG. 4 is a top plan view of the scaffold structure illustrated in FIG. 1.
Figure 5:
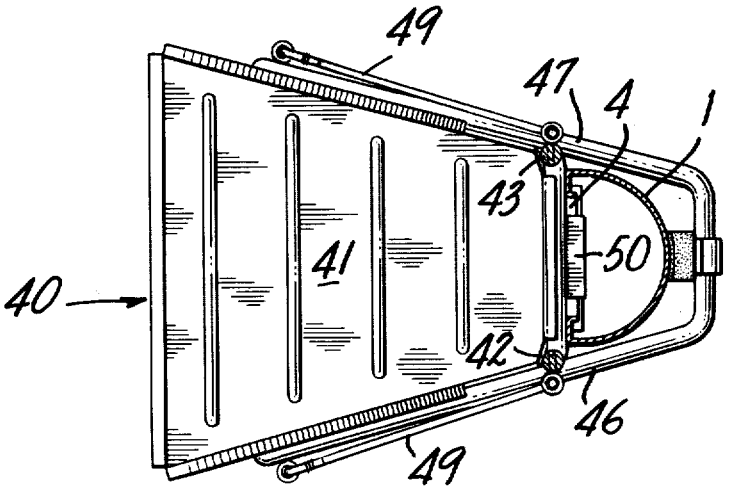
FIG. 5 is a cross-sectional view of the scaffold structure taken across the section line V—V in FIG. 2.
Figure 6:
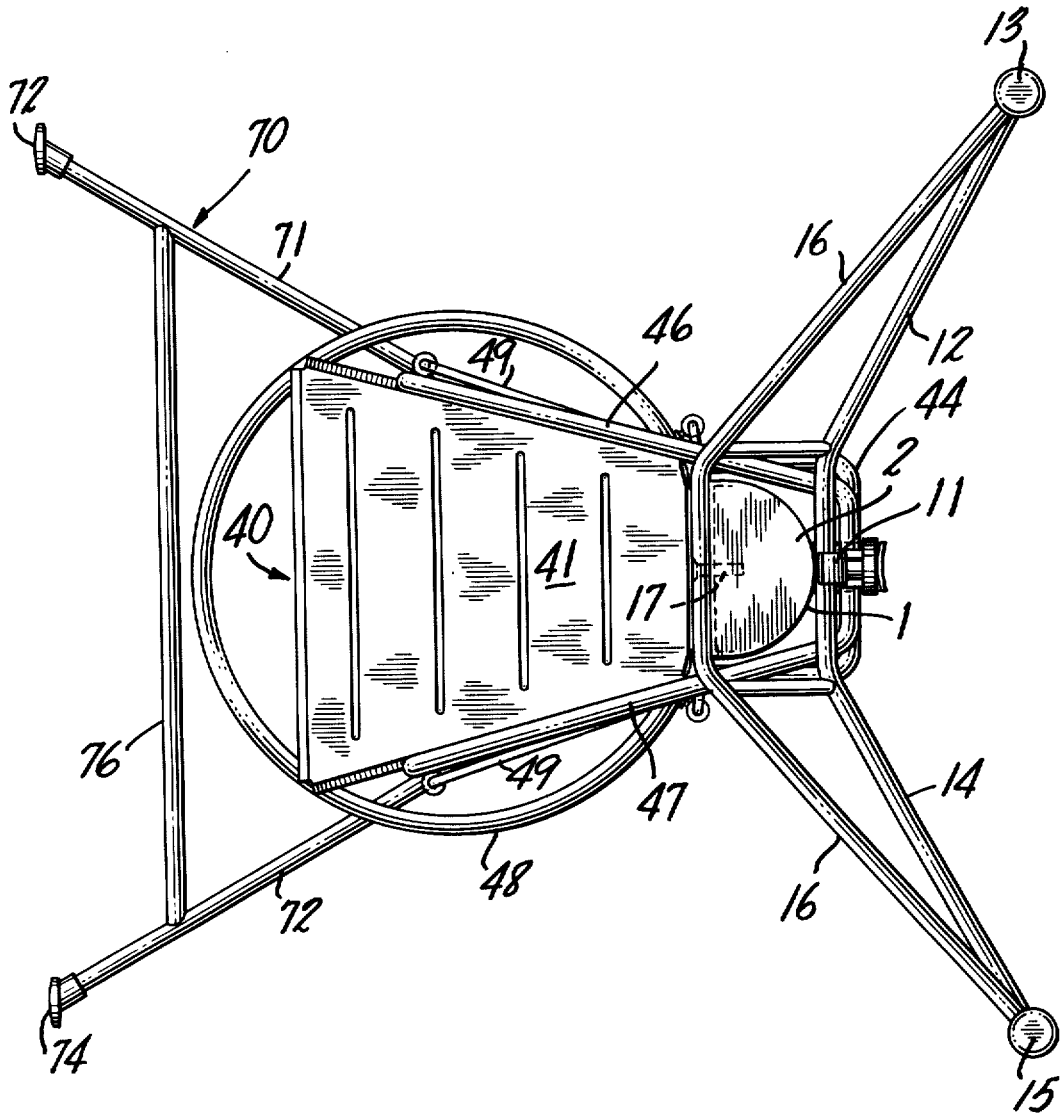
FIG. 6 is a bottom plan view of the scaffold structure illustrated in FIG. 1.

As shown in the drawings, the scaffold structure according to the present invention is comprised of a tubular column 1 positioned in use in a generally vertical orientation. When the tubular column 1 is positioned vertically it has a lower base end portion 2 and an upper top end portion 3. Base supporting means 10 is attached to the tubular column 1 at the lower base end portion 2 thereof and supports the tubular column 1. And as discussed below, the base supporting means 10 is also effective for imparting torsional rigidity to the tubular column 1. Top supporting means 70 supports the top end portion 3 of the tubular column 1 and maintains the column 1 in a generally vertical orientation. The top supporting means 70 is also effective to impart torsional rigidity to the column 1. The positionable platform assembly 40 includes a platform 41 dimensioned to permit a worker to stand thereon, and mounting means for positionably mounting the platform 41 on the tubular column 1 at selected positions along the length of the column 1. The mounting means permits selection and adjustment of the height of the platform 41 above the base end portion 2 of the tubular column 1.

The column structure 1 advantageously has a non-circular cross section. In the preferred embodiment the cross section of the tubular column 1 is D-shaped and the side of the tubular column 1 includes a cylindrical portion and a flat portion. The flat portion has a plurality of openings 4 dimensioned to allow a user of the scaffold structure to insert his hands and feet into the openings 4 so that he can climb up the tubular column 1. The edges of the openings 4 are rounded to prevent the user's hands and feet from being cut as he climbs the column 1. Alternatively, a bar can be attached to the column 1 along the bottom edge of each of the openings 4 to provide comfortable steps and facilitate climbing of the column 1.

The base supporting means 10 is comprised of a rigid frame which engages the lower base portion 2 of the tubular column 1 at positions along the length of the lower base portion 2 and on opposite sides of the tubular column. The rigid frame includes hinge means 11 defining a hinge mounted on the tubular column 1 at the lower base portion 2 thereof at a distance from the lower end of the tubular column, and a pair of rigid legs 12, 14 having respective first ends 13, 15 spaced apart. The pair of rigid legs 12, 14 respectively extend toward and meet at the hinge means 11 mounted on the tubular column 1, and the pair of legs 12, 14 are oriented relative to the tubular column 1 with the lower end of the column and the respective first ends 13, 15 defining a triangle generally perpendicular to the tubular column 1 when it is a vertical orientation and supported by the base supporting means 10. A brace 16 spans between the respective first ends 13, 15 of the legs 12, 14 and extends around the flat side portion of the tubular column 1 opposite the side on which the hinge means 11 is mounted. The brace 16 includes a pin 17 for releasably engaging the bottom end of the tubular column 1 on the flat side portion opposite the hinge means 11 when the tubular column is oriented generally vertical. The pin 17 releases from the bottom end of the tubular column 1 as the tubular column 1 is pivoted about the hinge means 11 in a direction to move the bottom end away from the frame, and which is indicated by the arrow in FIG. 1.

The top supporting means 70 is comprised of a rigid frame including a pair of rigid legs 71, 73 having respective first ends 72, 74 spaced apart and respectively extending toward and meeting at the tubular column 1. The pair of rigid legs 71, 73 meet and merge together to define means for engaging the top end portion 3 of the tubular column 1. The means for engaging the top end portion further comprise a bracket 75 enclosing the tubular column. A brace 76 spans between the pair of rigid legs 71, 72 and a second brace 77 defines a second bracket enclosing and gripping the tubular column and having a portion complementary to a substantial portion of the cross section of the tubular column 1 for preventing rotation of the second bracket and the rigid legs 71, 73 relative to the tubular column 1. In the preferred embodiment the brace 77 has a straight portion adjacent the flat side portion of the tubular column 1 while the bracket 75 holds the brace 77 against the flat portion of the tubular column 1. Consequently, rotation of the rigid frame comprising the top supporting means 70 is impossible.

The mounting means for mounting the positionable platform assembly 40 is comprised of releasable engaging means on the platform 41 for releasably engaging the tubular column 1 for maintaining the platform 41 at a fixed position along the length of the tubular column 1. Positioning means for maintaining the platform 41 adjacent the tubular column and for imparting torsional rigidity to the tubular column is comprised of a frame having a pair of opposed rails 42, 43 on opposite sides of the tubular column 1, a bracket 44 for slideably mounting the pair of frame rails 42, 43 on the tubular column 1, and a bracket 45 for moveably mounting the platform on the frame to move between a position with the releasable engaging means of the platform engaged with the tubular column 1, to thereby maintain the platform 41 and the frame at a fixed height on the tubular column, and the position with the releasable engaging means disengaged from the tubular column to thereby allow the platform 41 and the frame to travel along the length of the tubular column.

The platform 41 is generally planar and is positioned generally perpendicular to the tubular column 1 when the releasable engaging means engages the tubular column 1. The bracket 45 for movably mounting the platform 41 on the frame has two arms 46,47 each connected to a respective edge portion of the platform at positions remote from the tubular column 1. The arms 46, 47 of the bracket 45 are respectively mounted at the lower ends of the frame rails 42, 43 and are mounted to pivot. When the arms 46, 47 pivot downwardly the platform 41 pivots to a position with its releasable engaging means engaged with the tubular column 1. On the other hand, when the arms 46, 47 pivot upwardly the platform 41 is displaced away from the tubular column 1 and the releasable engaging means disengage from the column 1 to allow the entire moveable platform assembly to travel along the length of the tubular column 1.

The releasable engaging means are comprised of a projection 50 along the edge of the platform 41 facing the column 1 which is dimensioned to fit within an opening 4 in the tubular column 1 and rest on the lower edge of such an opening when the arms 46, 47 are pivoted downward. The engagement of the projection 50 with an opening 4 prevents downward travel of the platform assembly.

The scaffold structure according to the present invention is used by first positioning the base supporting means 10 near a vertical structure, such as a wall, on which work is to be performed, and with the positionable platform assembly 40 and the top supporting means 70 facing the vertical structure. The tubular column 1 is then pivoted slightly forward so that the ends 72, 74 of the arms 71, 73 of the top supporting means rest against the vertical structure. The cooperation of the top supporting means 70 and the base supporting means 10 are together effective for maintaining the tubular column 1 in an upright or generally vertical position. The position of the top supporting means 70 is adjusted by a rope or line attached thereto.

Thereafter, a user of the scaffold structure raises the safety rail 48, steps onto the platform 41, lowers the safety rail 48 and faces the flat side portion of the tubular column 1. The user then loops harness 49 over his shoulders and commences climbing the tubular column 1 until he reaches a height at which he is to perform work on the adjacent vertical structure against which the scaffold structure is leaning. The harness 49 is connected to the platform 41 or the arms 46, 47 of the bracket supporting the platform 41. Consequently, as the user of the scaffold structure climbs the tubular column 1 the arms 46, 47 are pivoted upwardly by the harness 49 so that the platform 41 pivots upwardly and the projection 50 is disengaged from the tubular column 1.

As the user of the scaffold structure continues to climb the harness 49 pulls the entire moveable platform assembly 40 along with him. When he has reached a desired height he need simply only crouch slightly to allow the arms 46 and 47 at the platform 41 to pivot downwardly until the projection 50 of the platform 41 engages the vertical column 1. The height of the positionable platform assembly 40 is then fixed and the user of the scaffold structure can perform work on the adjacent vertical structure against which the scaffold structure is leaning.

When the user of the scaffold structure has completed his work he simply climbs down the scaffold structure in the same manner that he climbed up it. First, he again loops the harness 49 over his shoulders and moves upwardly slightly to pivot the arms 46, 47 and the platform 41 upwardly to disengage the platform 41 from the vertical column 1. He then begins to climb down the vertical column 1 using the openings 4 as steps. As he climbs down gravity pulls the positionable platform assembly 40 down with him. But the harness 49 prevents the positionable platform assembly 40 from traveling faster then he climbs down the vertical column 1. After he has reached the bottom of the scaffold structure he removes the harness 49, raises the safety rail 48, and steps away from the platform assembly.

When the scaffold structure is no longer required it is simply carried away from the work site. It can be stored in an upright position, as it is illustrated in the Figs. Alternatively, it can be stored lying down with the base supporting means resting in the normal position and with the vertical column 1 pivoted to almost a completely horizontal position with the top supporting means resting on the ground or floor. The arms 71, 73 of the top supporting means are sufficiently long so that the positionable platform assemble 40 does not rest on the ground.

What I claim is:

1. A scaffold structure comprising:

a tubular column positioned in use in a generally vertical orientation and when so positioned having a lower base end portion and an upper top end portion, said tubular column having a vertical flat side surface portion extending along a substantial portion of its length and openings through the flat side surface portion regularly spaced along its length and dimensioned to define handholds and footholds to permit a person to climb said tubular column;

base supporting means for supporting the base end portion of said tubular column and for imparting torsional rigidity to said tubular column and maintaining said tubular column in a generally vertical orientation;

top supporting means for supporting the top end portion of said tubular column and for imparting torsional rigidity to said column and maintaining said tubular column in a generally vertical orientation; and a positionable platform assembly including a platform dimensioned to permit a worker to stand thereon, and mounting means for positionably mounting said platform assembly on said tubular column at selected positions along the length thereof to permit selection and adjustment of the height of said platform above said base end portion of said tubular column.

2. A scaffold structure according to claim 1, wherein said base supporting means comprises a rigid frame and means for engaging said lower base portion of said tubular column at positions along the length of said lower base portion and on opposite sides of said lower base portion for securing said lower base portion at the portions engaged to said rigid frame for imparting torsional rigidity to said tubular column.

3. A scaffold structure according to claim 2, wherein said rigid frame includes hinge means for defining a hinge mounted on said tubular column at the lower base portion thereof at a distance from the lower end of said tubular column; a pair of rigid legs having respective first ends spaced apart and respectively extending toward and meeting at said hinge means mounted on said tubular column, said pair of legs oriented relative to said tubular column with said lower end of said column and said respective first ends defining a triangle generally perpendicular to said tubular column when said tubular column is in a generally vertical orientation and supported by said base supporting means; a brace spanning between said respective first ends of said legs and extending around said tubular column on a side thereof opposite said hinge means, said brace including means for releasably engaging said bottom end of said tubular column on a side thereof opposite said hinge means when said tubular column is oriented generally vertical and is supported by said base supporting means and for releasing said bottom end of said tubular column as said tubular column is pivoted about said hinge means in a direction to move said bottom end away from said base.

4. A scaffold structure according to claim 1, wherein said top supporting means is comprised of a rigid frame, and means for engaging said top end portion of said tubular column at positions along the length of said top end portion on opposite sides of said top end portion and around a substantial peripheral portion of said tubular column for securing said top end portion at the positions engaged to said rigid frame for imparting torsional rigidity to said tubular column.

5. A scaffold structure according to claim 1, wherein said rigid frame is comprised of a pair of rigid legs having respective first ends spaced apart and respectively extending toward and meeting at said tubular column, said pair of rigid legs meeting and merging together to define said means for engaging said top end portion, said means for engaging said top end portion comprising a bracket enclosing said tubular column; a brace spanning between said pair of rigid legs and defining a second bracket enclosing and gripping said tubular column and having a portion complementary to a substantial portion of the cross section of said tubular column for preventing rotation of said second bracket and said rigid legs relative to said tubular column.

6. A scaffold structure according to claim 1, wherein said mounting means mounting said positionable platform assembly is comprised of said platform including releasable engaging means for releasably engaging said tubular column for maintaining said platform at a fixed position along the length of said tubular column, and positioning means for maintaining said platform adjacent said tubular column and for imparting torsional stability to said tubular column.

7. A scaffold structure according to claim 6 wherein said positioning means is comprised of a frame; means for slidably mounting said frame on said tubular column; and means for movably mounting said platform on said frame to move between a position with said releasable engaging means of said platform engaged with said tubular column to thereby maintain said platform and said mounting means at a fixed position on said tubular column and a position with said releasable engaging means disengaged from said tubular column to thereby allow said platform and said mounting means to travel along the length of said tubular column.

8. A scaffold structure according to claim 7, wherein said platform is a generally planar structure positioned generally perpendicular to said tubular column when said releasable engaging means engages said column; and said means for movably mounting said platform is comprised of a bracket having two arms each connected to a respective edge portion of said platform at positions remote from said tubular column and each mounted to pivot on said frame.

9. A scaffold structure according to claim 7, wherein said releasable engaging means is comprised of a projection extending from an edge of said platform facing said flat side surface of said tubular column and dimensioned to extend into an opening through said flat side surface for engaging said column and for disengaging from said column when said platform is moved.

10. A scaffold structure comprising:

a tubular column positioned in use in a generally vertical orientation and when so positioned having a lower base end portion and an upper top end portion;

base supporting means for supporting the base end portion of said tubular column and for imparting torsional rigidity to said tubular column and maintaining said tubular column in a generally vertical orientation;

top supporting means for supporting the top end portion of said tubular column and for imparting torsional rigidity to said column and maintaining said tubular column in a generally vertical orientation; and a positionable platform assembly including a platform dimensioned to permit a worker to stand thereon, and mounting means for positionably mounting said platform assembly on said tubular column at selected positions along the length thereof to permit selection and adjustment of the height of said platform above said base end portion of said tubular column;

wherein said base supporting means comprises a rigid frame and means for engaging said lower base portion of said tubular column at positions along the length of said lower base portion and on opposite sides of said lower base portion for securing said lower base portion at the portions engaged to said rigid frame for imparting torsional rigidity to said tubular column.

11. A scaffold structure according to claim 10, wherein said rigid frame includes hinge means for defining a hinge mounted on said tubular column at the lower base portion thereof at a distance from the lower end of said tubular column; a pair of rigid legs having respective first ends spaced apart and respectively extending toward and meeting at said hinge means mounted on said tubular column, said pair of legs oriented relative to said tubular column with said lower end of said column and said respective first ends defining a triangle generally perpendicular to said tubular column when said tubular column is in a generally vertical orientation and supported by said base supporting means; a brace spanning between said respective first ends of said legs and extending around said tubular column on a side thereof opposite said hinge means, said brace including means for releasably engaging said bottom end of said tubular column on a side thereof opposite said hinge means when said tubular column is oriented generally vertical and is supported by said base supporting means and for releasing said bottom end of said tubular column as said tubular column is pivoted about said hinge means in a direction to move said bottom end away from said base.

12. A scaffold structure comprising:

a tubular column positioned in use in a generally vertical orientation and when so positioned having a lower base end portion and an upper top portion;

base supporting means for supporting the base end portion of said tubular column and for imparting torsional rigidity to said tubular column and maintaining said tubular column in a generally vertical orientation;

top supporting means for supporting the top end portion of said tubular column and for imparting torsional rigidity to said column and maintaining said tubular column in a generally vertical orientation; and a positionable platform assembly including a platform dimensioned to permit a worker to stand thereon, and mounting means for positionably mounting said platform assembly on said tubular column at selected positions along the length thereof to permit selection and adjustment of the height of said platform above said base end portion of said tubular column;

wherein said top supporting means is comprised of a rigid frame, and means for engaging said top end portion of said tubular column at positions along the length of said top end portion on opposite sides of said top end portion and around a substantial peripheral portion of said tubular column for securing said top end portion at the positions engaged to said rigid frame for imparting torsional rigidity to said tubular column.

13. A scaffold structure comprising:

a tubular column positioned in use in a generally vertical orientation and when so positioned having a lower base end portion and an upper top end portion;

base supporting means for supporting the base end portion of said tubular column and for imparting torsional rigidity to said tubular column and maintaining said tubular column in a generally vertical orientation;

top supporting means for supporting the top end portion of said tubular column and for imparting torsional rigidity to said column and maintaining said tubular column in a generally vertical orientation; and a positionable platform assembly including a platform dimensioned to permit a worker to stand thereon, and mounting means for positionably mounting said platform assembly on said tubular column at selected positions along the length thereof to permit selection and adjustment of the height of said platform above said base end portion of said tubular column;

wherein said rigid frame is comprised of a pair of rigid legs having respective first ends spaced apart and respectively extending toward and meeting at said tubular column, said pair of rigid legs meeting and merging together to define said means for engaging said top end portion, said means for engaging said top end portion comprising a bracket enclosing said tubular column; a brace spanning between said pair of rigid legs and defining a second bracket enclosing and gripping said tubular column and having a portion complementary to a substantial portion of the cross section of said tubular column for preventing rotation of said second bracket and said rigid legs relative to said tubular column.

14. A scaffold structure comprising:

a tubular column positioned in use in a generally vertical orientation and when so positioned having a lower base end portion and an upper top end portion;

base supporting means for supporting the base end portion of said tubular column and for imparting torsional rigidity to said tubular column and maintaining said tubular column in a generally vertical orientation;

top supporting means for supporting the top end portion of said tubular column and for imparting torsional rigidity to said column and maintaining said tubular column in a generally vertical orientation; and a positionable platform assembly including a platform dimensioned to permit a worker to stand thereon, and mounting means for positionably mounting said platform assembly on said tubular column at selected positions along the length thereof to permit selection and adjustment of the height of said platform above said base end portion of said tubular column;

wherein said mounting means mounting said positionable platform assembly is comprised of said platform including releasable engaging means for releasably engaging said tubular column for maintaining said platform at a fixed position along the length of said tubular column, and positioning means for maintaining said platform adjacent said tubular column and for imparting torsional stability to said tubular column.

15. A scaffold structure according to claim 14 wherein said positioning means is comprised of a frame; means for slidably mounting said frame on said tubular column; and means for movably mounting said platform on said frame to move between a position with said releasable engaging means of said platform engaged with said tubular column to thereby maintain said platform and said mounting means at a fixed position on said tubular column and a position with said releasable engaging means disengaged from said tubular column to thereby allow said platform and said mounting means to travel along the length of said tubular column.

16. A scaffold structure according to claim 15, wherein said platform is a generally planar structure positioned generally perpendicular to said tubular column when said releasable engaging means engages said column; and said means for movably mounting said platform is comprised of a bracket having two arms each connected to a respective edge portion of said platform at positions remote from said tubular column and each mounted to pivot on said frame.

* * * * *